US010626889B2

(12) United States Patent
Händle et al.

(10) Patent No.: US 10,626,889 B2
(45) Date of Patent: Apr. 21, 2020

(54) HYDRAULIC SYSTEM

(71) Applicant: Moog GmbH, Böblingen (DE)

(72) Inventors: Werner Händle, Marbach a.N. (DE); Achim Helbig, Stuttgart (DE); Tino Kentschke, Weil der Stadt (DE)

(73) Assignee: Moog GmbH, Boblingen (DE)

( * ) Notice: Subject to any disclaimer, the term of this patent is extended or adjusted under 35 U.S.C. 154(b) by 310 days.

(21) Appl. No.: 15/316,085

(22) PCT Filed: Jun. 3, 2015

(86) PCT No.: PCT/EP2015/062409
§ 371 (c)(1),
(2) Date: Dec. 2, 2016

(87) PCT Pub. No.: WO2015/185644
PCT Pub. Date: Dec. 10, 2015

(65) Prior Publication Data

US 2017/0108014 A1 Apr. 20, 2017

(30) Foreign Application Priority Data

Jun. 4, 2014 (EP) ..... 14171118

(51) Int. Cl.
*F15B 11/02* (2006.01)
*F15B 11/036* (2006.01)
(Continued)

(52) U.S. Cl.
CPC ..... *F15B 11/022* (2013.01); *B30B 1/323* (2013.01); *B30B 15/161* (2013.01);
(Continued)

(58) Field of Classification Search
CPC ..... F15B 11/0365; F15B 11/06; B30B 1/323; B30B 15/161
(Continued)

(56) References Cited

U.S. PATENT DOCUMENTS 2,676,572 A * 4/1954 Perry ..... B23Q 5/266 91/361
3,017,865 A * 1/1962 Frantz ..... F15B 21/10 91/361
(Continued)

FOREIGN PATENT DOCUMENTS

CN 1192714 A 9/1998
CN 1791507 A 6/2006
(Continued)

OTHER PUBLICATIONS

English Translation of JP H0639285 (Base reference cited by applicant, published May 24, 1994. Translation retrieved from EPO, translation by EPO and Google translate Oct. 8, 2018).*
(Continued)

*Primary Examiner* — Nathaniel E Wiehe
*Assistant Examiner* — Richard C Drake
(74) *Attorney, Agent, or Firm* — Harter Secrest & Emery LLP

(57) ABSTRACT

The invention relates to a hydraulic drive (1) comprising a working cylinder (2) and a travel cylinder (3) which is mechanically connected to the working cylinder (2). The working cylinder (2) and the travel cylinder (3) each comprise an upper and a lower cylinder chamber (21, 22, 31, 32), and all four cylinder chambers (21, 22, 31, 32) of the working and travel cylinder (2, 3) are connected to one another in a suitable manner in a closed pressure circuit (4) which is filled and prestressed with a hydraulic fluid (F). A rotational speed-variable hydraulic machine (5) with a first and second pressure connection (51, 52) is arranged in the pressure circuit (4) in order to conduct the hydraulic fluid (F) between the individual cylinder chambers (21, 22, 31, 32) of the working and travel cylinder (2, 3) during the operation (B) of the hydraulic drive (1). At least one first and second distributing valve (6, 7) are arranged in the pressure circuit
(Continued)

Figure 1:
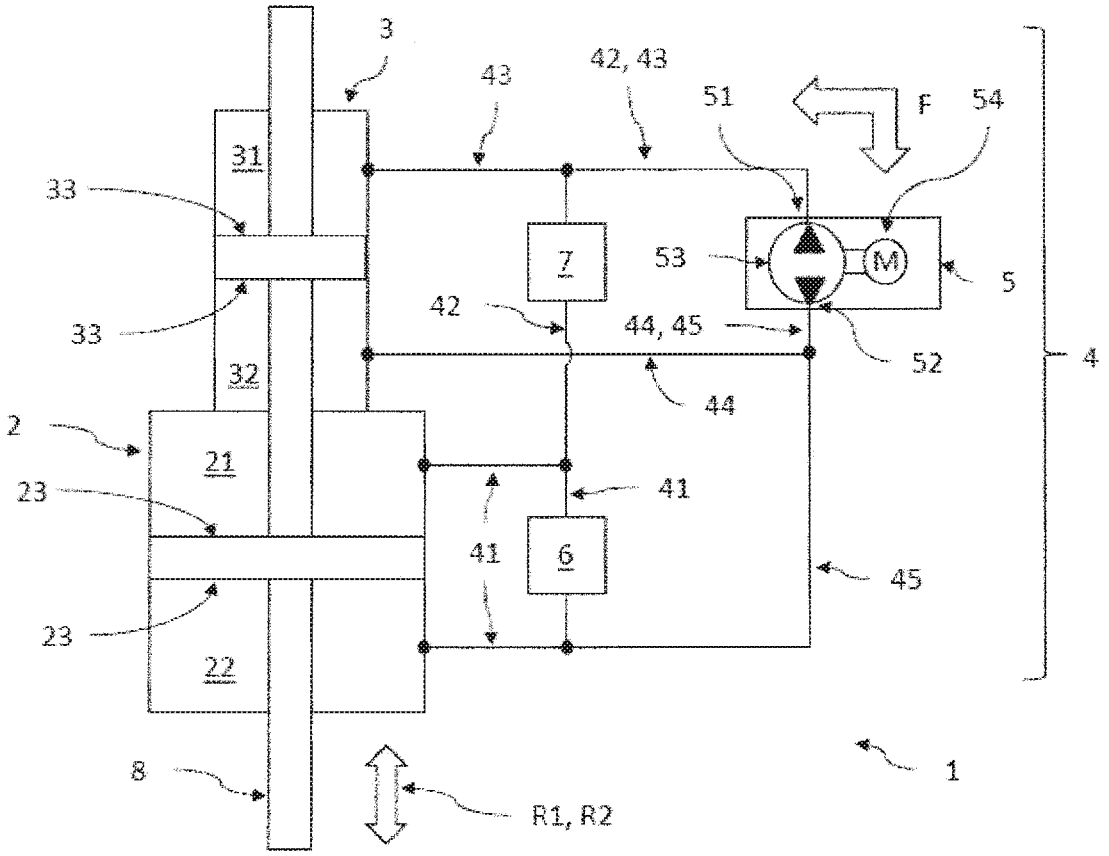

(4) such that the respective valve switch positions (61, 62, 71, 72, 73) which are suitable for the different operating phases of the hydraulic drive (1) together with the suitably driven hydraulic machine (5) allow a common movement of the work and travel cylinder (2, 3) in one or the other piston movement direction (R1, R2). For this purpose, preferably only the first and the second distributing valve (6, 7) are arranged in the pressure circuit (4). The hydraulic drive (1) requires a minimum number of components, maintains a low installation complexity, improves the energy efficiency, can be constructed in a compact manner, and can be operated in a sufficiently variable manner.

15 Claims, 3 Drawing Sheets

(51) Int. Cl.
*B30B 15/16* (2006.01)
*B30B 1/32* (2006.01)
*F15B 7/00* (2006.01)

(52) U.S. Cl.
CPC ..... *F15B 11/0365* (2013.01); *F15B 7/006* (2013.01); *F15B 2211/20515* (2013.01); *F15B 2211/20561* (2013.01); *F15B 2211/27* (2013.01); *F15B 2211/3058* (2013.01); *F15B 2211/7054* (2013.01); *F15B 2211/7056* (2013.01); *F15B 2211/775* (2013.01)

(58) Field of Classification Search
USPC ..... 91/509, 361; 60/560
See application file for complete search history.

(56) References Cited

U.S. PATENT DOCUMENTS 3,220,317 A * 11/1965 Fuell ..... B64C 13/42 244/194
4,030,299 A * 6/1977 Reuschel ..... B29C 45/67 60/560
5,865,088 A * 2/1999 Nakabayashi ..... B30B 1/32 60/560
6,003,429 A * 12/1999 Nakabayashi ..... B30B 1/323 60/560
7,010,912 B2 * 3/2006 Dantlgraber ..... B29C 45/6707 60/560
9,688,041 B2 * 6/2017 Scheidl ..... B30B 15/161
2006/0108172 A1 * 5/2006 Watanabe ..... B62D 5/065 180/422
2009/0211435 A1 * 8/2009 Yi ..... B66C 13/066 91/361
2011/0056368 A1 * 3/2011 McBride ..... F15B 1/024 91/165
2014/0026969 A1 * 1/2014 Helbig ..... F15B 20/002 137/2
2015/0377257 A1 * 12/2015 Nellessen ..... F15B 11/0365 60/398
2016/0084280 A1 * 3/2016 Maier ..... F15B 11/022 60/327
2016/0102685 A1 * 4/2016 Chester ..... F15B 11/003 60/327
2017/0136519 A1 * 5/2017 Erlenmaier ..... B21D 28/20
2017/0343020 A1 * 11/2017 Matsumoto ..... F16K 31/122

FOREIGN PATENT DOCUMENTS

DE 10 2011 116964 A1 5/2012
EP 0 311 779 A2 4/1989
JP 53-146081 A 12/1978
JP H06 39285 U 5/1994

OTHER PUBLICATIONS

International Search Report of the European Searching Authority (2 pages) Aug. 12, 2015.

* cited by examiner

HYDRAULIC SYSTEM

FIELD OF THE INVENTION

The invention relates to a hydraulic drive with mechanically coupled working and driving cylinders; to a press, bender or punch machine employing such a drive and to a method for operating such a drive.

BACKGROUND OF THE INVENTION

Systems employing hydraulic drives are utilized for diverse purposes, for example for presses, benders or punch machines. In the context of such applications, on the one hand, exertion of high force at a low speed of the piston (power mode) or of the connected tool (pressing, bending) is required, and on the other hand, a high speed at a low force of the piston (speed mode) or of the connected tool (travel of the tool to/away from the part to be machined) is required. Typically, two separate cylinders are used for this (one driving cylinder for quick movements with low force and one working cylinder for slow movements with high force), each having an actuator, which nowadays is configured as a continuous valve or a variable pump. These actuators require either a high pressure source or an open tank for additional supply of hydraulic fluid for the hydraulic drive. Due to the fixed assignment of one actuator to each driving and working cylinder, the number of required components, the installation effort and the investment costs are enormous. Furthermore, the energy efficiency is insufficient, particularly in partial-load range and when employing continuous valves.

Hydraulic drives with one driving and one working cylinder are known in the art. One such hydraulic drive is, for example, disclosed in JP H06 39285 U and features two mechanically coupled cylinders, two 2/2-way valves and a hydraulic pump, which are all connected with each other within a hydraulic circuit.

EP 2 480 405 B1 discloses a hydraulic drive with one driving cylinder and one working cylinder, with a variable speed pump as actuator in a closed hydraulic circuit, which has a pressure tank connected to it via a valve. The two cylinders are configured as differential cylinders separate from each other. However, a more compact design is desirable. In the arrangement disclosed there, the driving cylinder cannot be utilized as an additional force-exercising component in power mode, so that the force exercised during power mode has to come from the working cylinder alone, which reduces the efficiency of the drive. In speed mode, however, the speed of the tool is exclusively determined by its weight. Thus, in speed mode, no higher speed can be achieved than that which is predetermined by the weight force of the tool. Hence, the variable operation of this hydraulic drive is very limited.

Consequently, it is desirable to provide a hydraulic drive, which requires a minimum number of components, keeps the installation effort low, improves energy efficiency, can be built with a compact design and can be operated with a sufficient degree of variability.

SUMMARY OF THE INVENTION

The task of the present invention is to provide a hydraulic drive, which requires a minimum number of components, keeps the installation effort low, improves energy efficiency, can be built with a compact design and can be operated with a sufficient degree of variability.

This task is solved by a hydraulic drive comprising a working cylinder and a driving cylinder mechanically connected with the working cylinder, wherein the working cylinder and the driving cylinder each comprise one upper and one lower cylinder chamber, and all four cylinder chambers of the working cylinder and the driving cylinder are connected with each other in an appropriate way in a closed pressure circuit filled with a hydraulic fluid and preloaded, wherein a hydraulic machine with a first and a second pressure connection in the pressure circuit is arranged for transferring the hydraulic fluid between the individual cylinder chambers of the working cylinder and the driving cylinder during operation of the hydraulic drive, and wherein at least one first and one second way valve is arranged within the pressure circuit in such a way that each of their switch positions that are appropriate for the different operational phases of the hydraulic drive, along with the appropriately operated hydraulic machine, enable a combined movement of the working cylinder and the driving cylinder in one or the other piston movement direction, preferably, only the first and the second way valve are arranged in the pressure circuit for this.

Hereby, the term "working cylinder" refers to a cylinder that is used for executing a force-generating motion sequence, which means that it enables a movement of the piston rod with high force at a low speed. The term "driving cylinder", on the other hand, refers to a cylinder that is used for a quick motion sequence exerting a low force at high speed. In the arrangement according to the invention, the working cylinder and the driving cylinder are mechanically connected to each other. The working cylinder does hereby not actively contribute to the quick motion sequence but is moved along by the driving cylinder as a passive component. However, the driving cylinder actively supports the working cylinder during the force-generating motion sequence (high force, low speed) due to the fact that in the driving cylinder, a force is also generated in moving direction of the piston rod. By such means, the force-generating movement during pressing, bending or punching in a respective machine can be supported by the hydraulic drive according to the invention.

The driving cylinder and the working cylinder both have two cylinder chambers each, which chambers are separated by a piston having a piston surface facing the upper chamber and a piston surface facing the lower piston chamber respectively. Here, the cylinder chamber is referred to as the upper piston chamber, into which, during the force-generating movement (power mode down), the hydraulic fluid is conveyed via the hydraulic machine. Accordingly, the other cylinder chamber in the respective cylinder is referred to as the lower piston chamber, from which, during the force-generating movement (power mode up), the hydraulic fluid is extracted via the hydraulic machine.

In the present invention, the piston rod direction refers to the two directions, in which the piston rod can be moved. The piston rod direction is thus determined by the piston rod and by the alignment of the cylinders.

Here, the term "hydraulic fluid" refers to any fluid that is suitable for transmission of mechanical energy within hydraulic systems. Suitable hydraulic fluids have good lubricating qualities, a high aging resistance and a high wetting capacity and adhesive capacity. Moreover, they should have a good compatibility with seals as well as be free of resins and acids, exhibit a low effect of temperature on its dynamic and kinematic viscosity and also exhibit a low compressibility and low foam formation. Suitable hydraulic fluids are, for example, mineral oils, also referred to as hydraulic oils, or fluids of low flammability such as HFA, HFB, HFC or HFD. Transferring the hydraulic fluid hereby refers to the displacement (conveying) of hydraulic fluid through the pressure lines of the pressure circuit from one cylinder chamber into another cylinder chamber.

The hydraulic fluid is hereby transferred within a closed pressure circuit. The term "closed" refers to the absence of oil tanks that are open to the ambient air for oil replenishment within the hydraulic drive. The closed pressure circuit is a system comprising multiple pressure lines, which the hydraulic fluid cannot leave, except when there is a leak. The pressure circuit is formed by different pressure lines that connect the hydraulic machine with the cylinders. The pressure circuit can hereby comprise pressure lines, which branch out into multiple lines, or comprise connection points, where multiple pressure lines are united into one subsequent pressure line. Thus, the hydraulic drive according to the invention can be operated in the closed pressure circuit without having oil tanks or oil compensation vessels that are open to the ambient air connected to it. The pressure circuit is hereby preloaded, i.e. exposed to a heightened permanent pressure. The preload of the hydraulic fluid increases the compressive modulus of the fluid. This results in an increased eigenfrequency of the system, which in turn leads to improved dynamic characteristics. In addition to that, the preload helps to prevent the pump from being damaged by cavitation effects. Operating the hydraulic machine using hydraulic fluids that are not preloaded would have the effect that these fluids would first be released or compressed before starting to move within the pressure circuit. Hence, pressure circuits that are not preloaded work with a time delay of the hydraulic movement and lose drive energy in the process, due to the compression and release processes within the hydraulic fluid as it is conveyed through the hydraulic machine. Hence, the preload pressure inside the hydraulic drive according to the invention is preferably at least 0.5 MPa (5 bar). The preload pressure can be kept at a constant level, for example, via a pressure source, which is connected to the pressure circuit via a non-return valve. The non-return valve enables the pressure source to compensate leakages. In case of a perfectly tight hydraulic drive and/or pressure circuit and an incompressible fluid, this pressure source would not be needed for the operation of the hydraulic drive.

The hydraulic machine with variable speed is thereby integrated into the pressure circuit by having both of its pressure connections (first and second pressure connection) connected with the pressure lines of the pressure circuit.

Operation of the hydraulic drive thus refers to an entire movement cycle of the components that are moved by the hydraulic drive. The movement cycle is entirely completed when the same position of the cylinder and the piston rod is reached again after passing an upper dead center and a lower dead center. Dead center hereby refers to the point, at which the piston rod comes to rest and subsequently reverses its movement direction. One operation cycle is thereby divided into different operation phases of the hydraulic drive. In the operation phase "speed mode down", the hydraulic drive extends the piston rod at high speed and low force, whereas in the operation phase "power mode down", the movement is continued in the same direction at low speed and high exertion of force. When the dead center is reached, the operation phase "force generation" commences, until the hydraulic drive is released and the movement direction can be reversed. Subsequently, the operation phase "power mode up" can be performed. During this operation phase, the piston rod is moved at low speed and high exertion of force, whereby the direction of the movement and of the force is reversed. During the operation phase "speed mode up", the piston rod is moved at high speed and low force to the upper dead center. After that, the operation phase "speed mode down" or the operation mode "standstill" can follow, in which the hydraulic drive is resting.

The hydraulic drive according to the invention requires a minimum number of components, keeps the installation effort low, improves the energy efficiency, can be built in a more compact manner and can be operated in a sufficiently variable fashion. In particular, the hydraulic drive requires only one single actuator (the hydraulic machine), in order to supply both, the driving cylinder and the working cylinder.

In one embodiment, the first way valve is arranged inside a first pressure line of the pressure circuit, which connects the two cylinder chambers of the working cylinder with each other, and in a first switch position enables a two-way passage of the hydraulic fluid for the purpose of short-circuiting the two cylinder chambers. Through this first pressure line with this first way valve, the cylinder chambers of the working cylinder can be short circuited, so that, for example, in speed mode, the working cylinder cannot generate a counter pressure against the moving direction of the driving cylinder. Due to the short circuit of the cylinder chambers of the working cylinder, there is approximately equal pressure in both cylinder chambers, resulting in no relevant force being exerted through the hydraulic fluid onto the piston surface inside the working cylinder. The first pressure line can hereby comprise branchings into further pressure lines. The way valve can be any suitable way valve with at least two switch positions. In a preferred embodiment, the first way valve is a 2/2-way valve and is intended to lock the pressure line in both directions in its second switch position. This switch position can enable a force to be generated in the working cylinder, for example, during the power mode up or power mode down movements.

In a further embodiment, the first way valve is a continuous valve. This enables a smoother switching between the operation phases. Furthermore, the second way valve can also be a continuous valve.

In another embodiment, the first pressure connection of the hydraulic machine is connected with the upper cylinder chambers of the working cylinder and the driving cylinder via a second and third pressure line, whereby the second way valve is arranged in the second pressure connection to the upper cylinder chamber of the working cylinder. The hydraulic machine conveys the hydraulic fluid within the pressure circuit in one direction or the other. Therefore, the hydraulic machine has two connections—one first and one second pressure connection. The second pressure line can hereby either lead directly into the upper cylinder chamber of the working cylinder or, in one embodiment, lead into the first pressure line and thus be connected to the upper cylinder chamber of the working cylinder via the first pressure line. This enables the hydraulic machine to convey hydraulic fluid into the upper cylinder chambers of the two cylinders via its first pressure connection, thus generating pressure and force in both cylinders for the power mode down, or, depending on the switching position of the second way valve, convey the hydraulic fluid only into the upper cylinder chamber of the driving cylinder for a speed mode. The second way valve can be any suitable way valve with at least three switch positions. To this end, in a preferred embodiment, the second way valve is a 2/3-way valve with three different switch positions.

In another embodiment, a first switch position of the second way valve enables a two-way passage of the hydraulic fluid for short-circuiting the two upper cylinder chambers, while a second switch position of the second way valve is a non-return valve switch position, whereby the passage in the direction of the upper cylinder chamber of the driving cylinder is blocked and the flow in the reverse direction is enabled, and a third switch position of the second way valve blocks the second pressure line in both directions. The first switch position of the second way valve enables, for example, a force reduction after completion of the power mode down to be performed, as this switch position enables the hydraulic fluid to leave the two upper cylinder chambers at corresponding operation of the hydraulic machine, thus reducing the force exerted onto the piston surfaces. The second switch position of the second way valve enables, for example, a pressure compensation by conducting pressure from the upper cylinder chamber of the driving cylinder into the opened bypass (short circuit) of the working cylinder in speed mode, because the non-return position opens the second way valve in the direction of the working cylinder, when a minimum pressure is exceeded. The same happens, for example, during power mode down, where hydraulic fluid is pressed (conveyed) by the hydraulic pump into the second and third pressure line. The pressure for the power mode down by far exceeds the locking pressure of the non-return valve position, so that the second way valve opens the second pressure line to the upper cylinder chamber of the working cylinder also during power mode down. The second pressure line can hereby either lead directly into the upper cylinder chamber of the working cylinder or, in one embodiment, lead into the first pressure line and thus be connected to the upper cylinder chamber of the working cylinder via the first pressure line.

In a further embodiment, the second pressure connection of the hydraulic machine is connected with the lower cylinder chambers of the working cylinder and the driving cylinder via a fourth and a fifth pressure line of the pressure circuit without interposition of any way valves. As soon as the hydraulic machine starts conveying hydraulic fluid into the second and third pressure lines via the first pressure connection, the hydraulic fluid has to be subsequently supplied into the hydraulic machine via the other (second) pressure connection. For this purpose, the latter is connected to the lower cylinder chambers of the two cylinders without interposed way valves. When hydraulic fluid is conveyed into the lower cylinder chambers of the driving and working cylinder, the opposite applies respectively. Then, the hydraulic fluid is subsequently conveyed into the hydraulic machine via the first pressure connection, whereby the first and second way valves exhibit a correspondingly suitable switch position.

In one embodiment, both the working cylinder as well as the driving cylinder are double rod cylinders, with respective ring surfaces as piston surfaces. A double rod cylinder is equipped with a piston rod on both sides of the piston surface. The volume of the fluid that is flowing into one chamber corresponds to the volume of the fluid that is flowing out of the other chamber. Hence, the volume flow balance of the closed hydraulic drive is perfectly balanced.

In yet another embodiment, the working cylinder and the driving cylinder are arranged as a tandem cylinder with a shared piston rod. In case of a tandem cylinder, the two cylinders are connected to each other in such a way that the piston rod of the working cylinder passes through the bottom of the driving cylinder and functions also as its piston rod or is directly connected to its piston rod. This enables a particularly small overall size. In addition to that, when using appropriate switch positions of the way valves, a coupling of the piston surfaces can be achieved during power mode down and power mode up, so that a higher force can be achieved during power mode with the same hydraulic fluid pressure generated by the hydraulic machine, as compared to when the piston rods are not coupled, as for example would be the case with separate differential pistons, particularly where the piston chamber that is opposite the ring chamber of the driving cylinder is not connected to the pressure circuit.

In a further embodiment, the piston surfaces of the driving cylinder are smaller than the piston surfaces of the working cylinder. This enables particularly high speeds of the piston rod to be achieved during speed mode. Preferably, the piston surface of the working cylinder is at least by 100% bigger than that of the driving cylinder, in a particularly preferred case by at least 300% bigger, in an even more preferred case by at least 500% bigger.

In a further embodiment, the hydraulic machine comprises only one pump and one motor mechanically coupled with the pump for driving the pump, whereby the motor is a variable speed motor and/or the pump is a variable pump. With only one pump present, the hydraulic drive comprises only one actuator (the pump) and thereby avoids an unnecessary higher number of components. Preferably, the motor is an electric motor. In a particularly preferred scenario, the motor is a variable speed electric motor and the pump is a fixed displacement pump. The pump drive with variable speed significantly improves the energy efficiency of the hydraulic drive. The above design of the hydraulic machine can also enable a decentralization of the drive.

The invention also relates to a pressing, bending or punch machine comprising a hydraulic drive according to the invention.

Furthermore, the invention relates to a method for operating the hydraulic drive according to the invention, comprising mechanically coupled working and driving cylinders, each having one upper and one lower cylinder chamber, whereby all four cylinder chambers of the working and driving cylinders are connected to each other in an appropriate way within a closed pressure circuit that is filled with a hydraulic fluid and preloaded, and a hydraulic machine with a first and a second pressure connection within the pressure circuit for transferring the hydraulic fluid between the individual cylinder chambers of the working and driving cylinders during operation of the hydraulic drive arranged therein, comprising the following steps:

operating the hydraulic drive in speed mode up or down by means of the hydraulic machine and one first and one second way valve, whereby the first way valve is arranged in a first pressure line of the pressure circuit and is operated in a first switch position, which short-circuits the two cylinder chambers of the working cylinder for two-way passage of the hydraulic fluid, whereby the second way valve is operated in a non-return valve position, so that the passage in the direction of the upper cylinder chamber of the driving cylinder is blocked, and whereby the hydraulic machine conveys the hydraulic fluid for a movement of the piston rod in the direction of the lower cylinder chambers and for a movement in the direction of the upper cylinder chambers;

operating the hydraulic drive in power mode, whereby the first way valve is operated in a second switch position, which blocks the first pressure line in both directions, whereby the second way valve remains in the non-return valve position of the speed mode, and whereby the hydraulic machine conveys the hydraulic fluid in the direction of the upper or the lower cylinder chambers;

releasing the hydraulic drive after power mode, whereby the first way valve remains in the switch position of the power mode, whereby the second way valve is operated in a first switch position, which enables a two-way passage of the hydraulic fluid for short-circuiting the two upper cylinder chambers, and whereby the hydraulic machine conveys the hydraulic fluid in the direction of the lower or the upper cylinder chambers.

A particular advantage of the method according to the invention is that in speed mode, the movement direction can be changed without switching any of the valves. For reversing the movement direction, it is sufficient to reverse the conveying direction of the hydraulic machine.

In one embodiment, the method comprises the further step of operating the hydraulic drive during standstill, whereby the first and the second way valves are operated in switch positions, which block the corresponding pressure lines in both directions, and whereby the hydraulic machine does not convey the hydraulic fluid.

In one embodiment, the method comprises the further step of operating the hydraulic machine at variable speed by means of a mechanically coupled electric motor.

BRIEF DESCRIPTION OF THE ILLUSTRATIONS

Figure 2:
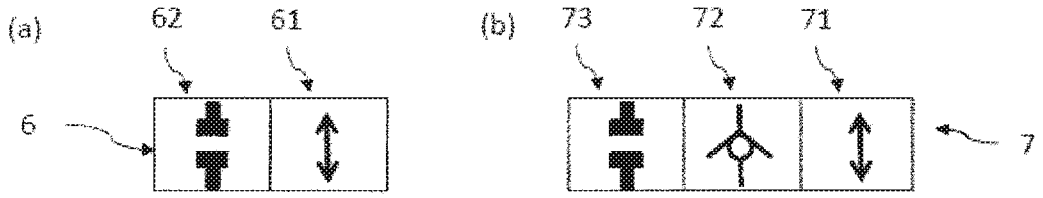
Figure 3:
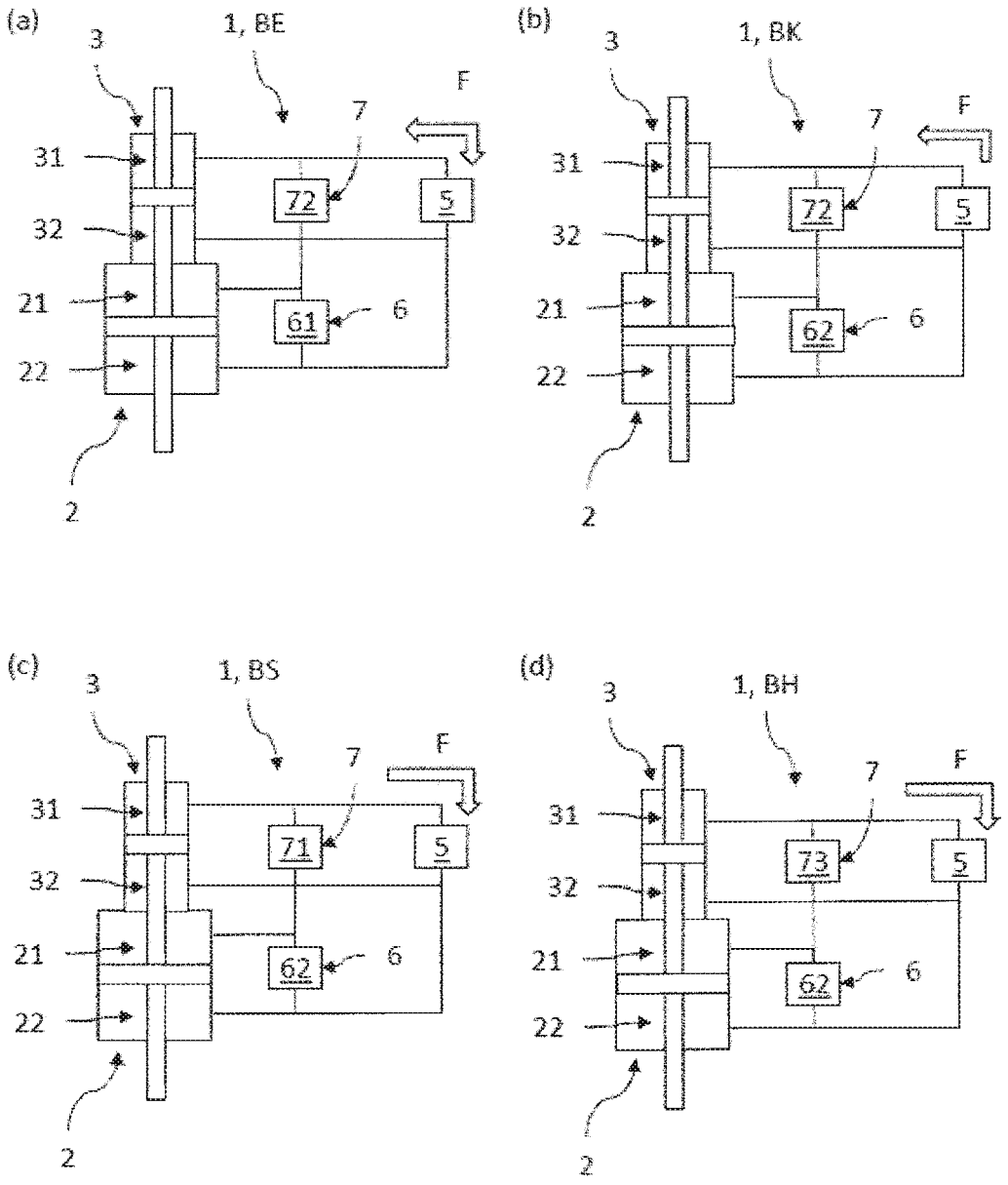
Figure 4:
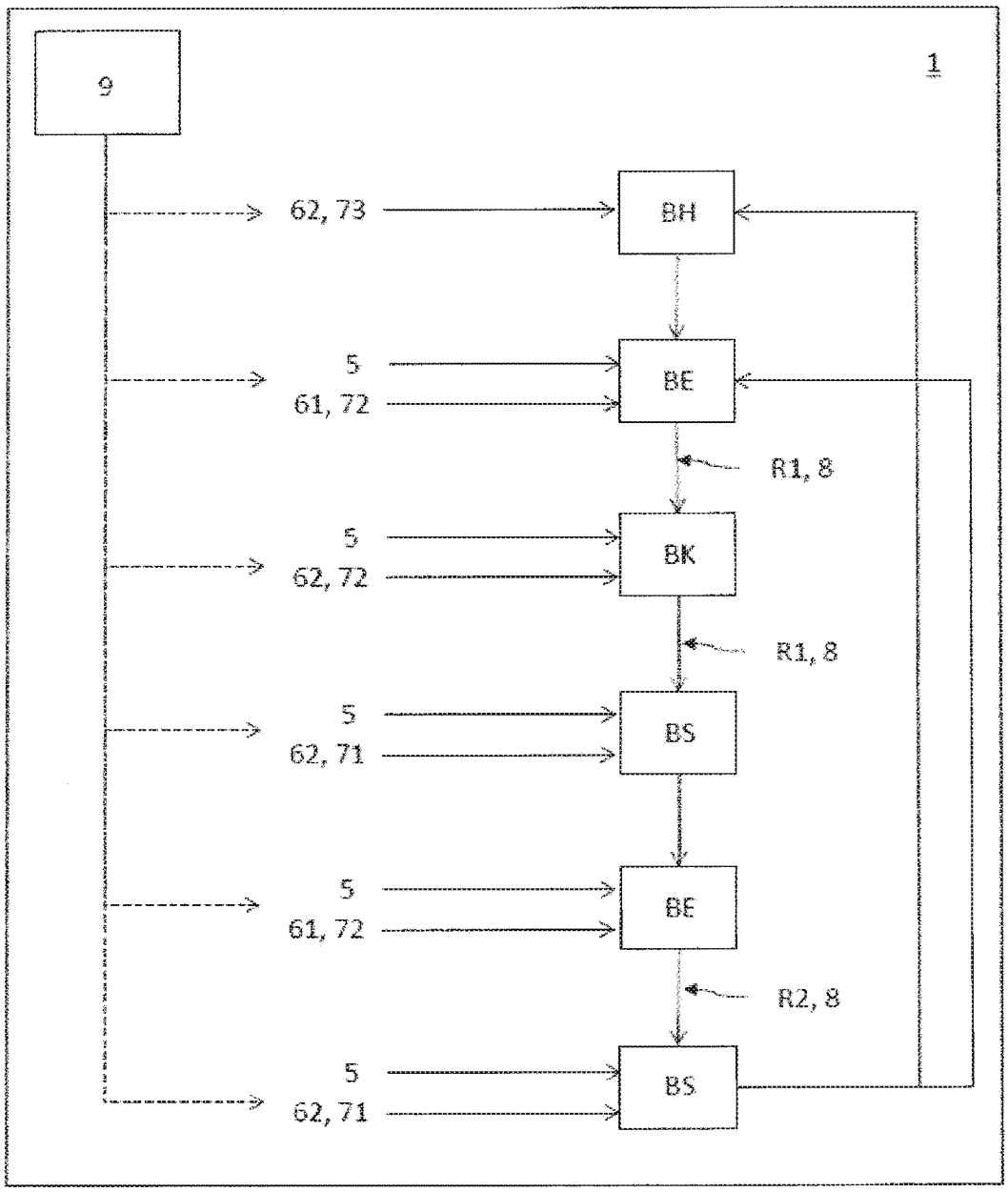

These and other aspects of the invention are shown in detail in the illustrations as follows:

FIG. 1: schematic representation of the hydraulic drive according to the invention;

FIG. 2: schematic representation of the switch positions of (a) the first way valve and (b) the second way valve in detail;

FIG. 3: switch positions of the way valves in (a) speed mode, (b) power mode, (c) force generation and (d) standstill;

FIG. 4: one embodiment of the method according to the invention.

DETAILED DESCRIPTION OF THE EXEMPLARY EMBODIMENTS

FIG. 1 shows a schematic representation of the hydraulic drive 1 according to the invention. The hydraulic drive 1 comprising one working cylinder 2 and one driving cylinder 3, each having one upper cylinder chamber 21, 31 and one lower cylinder chamber 22, 32, whereby the cylinders 2, 3 are arranged as double rod cylinders with respective ring surfaces 23, 33 and with a combined piston rod 8 as tandem cylinders in the direction of the piston movement R1, R2 one above the other. In this embodiment, the piston surfaces 33 of the driving cylinder 3 are designed smaller than the piston surfaces 23 of the working cylinder 2, in order to achieve a faster speed during speed mode while maintaining the same displacement volume per time unit by the hydraulic machine 5. For example, the ring surface 33 of the driving cylinder 3 is approx. 120 $cm^2$, and the ring surface 23 of the working cylinder 2 approx. 700 $cm^2$. With these ring surfaces, it is possible, for example, at a pressure of 30 MPa (300 bar) in the pressure circuit 4, to achieve a pressing force of 2,500 kN in power mode. However, in this embodiment, the ring surfaces 23, 33 have the same surface in the upper cylinder chamber and in the lower cylinder chamber of the cylinders 2, 3. Furthermore, in the hydraulic drive, all four cylinder chambers 21, 22, 31, 32 of the working and driving cylinders 2, 3 are connected with each other within a pressure circuit 4 that is closed, preloaded and filled with a hydraulic fluid F with the pressure lines 41, 42, 43, 44, 45, and a hydraulic machine 5 with variable speed with a first and a second pressure connection 51, 52 is arranged within the pressure circuit 4 for transferring the hydraulic fluid F (double arrow indicates the two possible displacement directions) between the individual cylinder chambers 21, 22, 31, 32 of the working and driving cylinders 2, 3 during operation of the drive 1. In this embodiment, the hydraulic machine 5 comprises only one pump 53 and one electric motor 54, which is mechanically coupled with the pump 53 for driving the pump 53 with variable speed. The mechanical coupling is represented by the double line between the pump 53 and the electric motor 54. For example, the pump 53 has a pump capacity of 1,300 L/min. In addition, a first way valve 6 and a second way valve 7 are arranged within the pressure circuit 4 in such a way that their respective switch positions that are appropriate for the different operation phases of the hydraulic drive 1 (see FIG. 2) along with the appropriately operated pump drive 5 enable a combined movement of the working and driving cylinders 2, 3 in one or the other piston movement direction R1, R2. For this purpose, a first pressure line connects the upper cylinder chamber 21 with the lower cylinder chamber 22 of the working cylinder via the first way valve 6 that is arranged in the first pressure line 41. For the ring surfaces specified above, the flow capacity of the first pressure line 41 and the first way valve should, for example, exceed 4,000 L/min. The lower cylinder chambers 22 and 32 of the working and driving cylinders 2, 3 are connected with each other via the pressure lines 45 and 44 without any switchable way valve being arranged in this connection. The upper cylinder chamber 31 and the lower cylinder chamber 32 of the driving cylinder 3 are connected with each other via the third and fourth pressure lines 43 and 44, whereby here the hydraulic machine 5 is interposed via its pressure connections 51, 52. Furthermore, the third pressure line 43 is connected via the second pressure line 42 with the first pressure line 41 in such a way that between the third pressure line 43 and the upper cylinder chamber 21 of the working cylinder 2 the second way valve 7 is arranged in the second pressure line 42. The second way valve 7 can have a lower flow capacity compared to the first way valve, for example higher than 700 L/min. The connection of the third pressure line 43 with the lower cylinder chamber 22 of the working cylinder 2, however, is realized via the second pressure line 42 with the second way valve 7 and the first pressure line 41 with the first way valve 6 arranged in between. Through the guiding of the piston surfaces 23, 33 inside the cylinders 2, 3, the piston rod 8 can only move in the directions R1, R2. In this embodiment, the hydraulic drive 1 does not need any other valves in addition to the first and second way valve 6, 7 for operation, so that the hydraulic drive 1 can be operated with a minimum number of components. The pressure lines 41, 42, 43, 44, 45 partly branch out within the pressure circuit 4 or partly converge within it. The branching points (converging points) are marked by black dots at the respective positions. The pressure lines that only cross each other's path without actually joining are depicted without these black dots, see the crossing pressure lines 42 and 44 between the way valves 6 and 7.

In FIG. 2, a schematic representation of the possible switch positions of (a) the first way valve and (b) the second way valve are shown in detail. The first way valve 6 is depicted in this embodiment as a 2/2-way valve and it enables in a first switch position 61 the hydraulic fluid F to pass through in both directions. In a second shift position 62, however, it blocks in both directions. The second way valve 7 in this embodiment is a 2/3-way valve 7 with three different switch positions 71, 72, 73. In a first switch position 71, the second way valve 7 enables the hydraulic fluid F to flow through in both directions, in a second switch position 72, the second way valve 7 comprises a non-return valve position, whereby the passage is blocked in one direction (here in the direction of the upper cylinder chamber 31 of the driving cylinder 3) and in a third switch position 73, the second way valve 7 blocks in both directions.

FIG. 3 shows switch positions of the way valves 6, 7 during (a) speed mode, (b) power mode, (c) force generation and (d) standstill, see also FIG. 2 as a supplement. For clarity reasons, the detailed drawings of the pressure lines in the pressure circuit 4 have been left out. For the designation of the pressure line 41, 42, 43, 44, 45 specified below please refer to FIG. 1.

During speed mode BE in FIG. 3*a* (down movement of the piston rod 8 in the direction R1 or up movement of the piston rod 8 in the direction R2, see FIG. 1), the first way valve 6 has the switch position 61 (passage of the hydraulic fluid F in both directions in the first pressure line 41). This connects the two cylinder chambers 21, 22 of the working cylinder 2 with each other and achieves a short circuit of the two cylinder chambers 21, 22, due to the hydraulic fluid F being enabled to flow in both directions. Thus, no resulting force can be exerted onto the piston surface of the working cylinder by the hydraulic fluid, so that the latter passively moves with the driving cylinder. During this time, the second way valve 7 is in the second switch position 72, the non-return valve position, whereby the passage in the direction of the upper cylinder chamber 31 of the driving cylinder 3 is blocked, while a passage of the hydraulic fluid F in the direction of the working cylinder 2 at a pressure higher than a threshold pressure is possible, and even at high pressure at the driving cylinder 3, a pressure compensation between the cylinder chambers 21, 22 of the working cylinder 2 is underway via the pressure line 41 that was opened by the first way valve 6. Hereby, during a speed mode BE down (R1), the hydraulic machine 5 conveys the hydraulic fluid F from the lower cylinder chamber 32 of the driving cylinder 3 via the pressure lines 44 and 43 into the upper cylinder chamber 31 of the driving cylinder 3, whereas during a speed mode BE up (R2), the hydraulic fluid F is conveyed from the upper cylinder chamber 31 of the driving cylinder 3 via the pressure lines 43 and 44 to the lower cylinder chamber 32 of the driving cylinder 3. Due to the switch positions 61, 72 of the way valves 6, 7, there is always a pressure compensation between the cylinder chambers 21, 22 inside the working cylinder 2, regardless in which direction and at which power the hydraulic machine 5 conveys the hydraulic fluid F.

For power mode down BK (FIG. 3*b*), the hydraulic machine 5 conveys the hydraulic fluid F through the first pressure connection 51 into the pressure lines 42, 43 in the direction of the upper cylinder chambers 21, 31 of the working and driving cylinders 2, 3. For that purpose, the second way valve remains in the non-return valve position 72, which enables a passage of the hydraulic fluid F, which now is under higher pressure due to the conveying performance of the hydraulic machine 5, in the pressure lines 42, 43 in the direction of the working cylinder 2. The first way valve 6 is now in the second switch position 62, which blocks the first pressure line 41 in both directions, so that the hydraulic fluid F, which is allowed through the second way valve 7 in switch position 72, can only get into the upper cylinder chamber 21 for generating pressure onto the piston surface 23. Parallel to this, the hydraulic fluid F is drained from the lower cylinder chambers 22, 32 via the fourth pressure connection 44, which is connected to the lower cylinder chamber 32 of the driving cylinder 3, and the fifth pressure line 45, which is connected to the lower cylinder chamber 22 of the working cylinder 2, and via the second pressure connection 52 of the hydraulic machine 5, and is further conveyed into the upper cylinder chambers 21, 31. Due to these pressure differences between the upper and lower cylinder chamber in both cylinders 2 and 3, a great force is generated, which moves the piston rod 8, albeit at a lower speed than during speed mode, as a larger volume of the hydraulic fluid has now to be transferred. During power mode BK, the working cylinder 2 and the driving cylinder 3 exert a combined force unto the piston rod 8 and are hence both actively involved in the power mode BK, which results in a more effective operation of the hydraulic drive 1. A particular advantage herein lies in the fact that according to the here suggested arrangement and design of the way valves 6 and 7, the switching from speed mode to power mode is achieved solely by switching the way valve 6 to the position that blocks the first pressure line 41 in both directions. This can, among other things, result in a jolt-free switchover, as only one way valve has to be switched and not a plurality of different way valves that might have different switching times and/or sizes, which would lead to respective jerks and/or a jolt during switching.

After completion of the power mode, the hydraulic drive has to be released via the operation phase release BS, so that subsequently, the piston rod can be moved into the other direction. For this purpose, the first way valve 6 remains in the second switch position 62, which blocks the first pressure line 41 in both directions, while the second way valve 7 is switched to the first switch position 71, where the second way valve 7 enables a two-way passage of the hydraulic fluid through the second pressure line 42, so that the pressure differences between the upper and lower cylinder chambers can be relieved via a conveying direction of the hydraulic fluid F from the upper cylinder chambers 21, 31 to the lower cylinder chambers 22, 32. The hydraulic fluid F is hereby conveyed from the upper cylinder chamber 31 of the driving cylinder 3 via the pressure lines 43 and 44 to the lower cylinder chamber 32. Simultaneously, the hydraulic fluid F is conveyed from the upper cylinder chamber 21 of the working cylinder 2 via the first pressure line 41 and via the second pressure line 42 with an open second way valve 7 into the lower cylinder chamber 22 via the fifth pressure line 45.

After the hydraulic drive has been released, the speed mode BE in upper direction can be performed with the switch positions according to FIG. 3*a* and the corresponding conveying direction of the hydraulic fluid F by the hydraulic machine 5, from the upper cylinder chamber 31 of the driving cylinder into the lower cylinder chamber 32.

If however, after a speed mode BE up, the machine driven by the hydraulic drive 1 is to remain in a holding position BH (operation phase holding position or standstill), the first way valve 6 remains in the second switch position 62, and the second way valve is switched to the third switch position 73, where it blocks the second pressure line 42 in both directions. While in holding position BH, the hydraulic machine 5 does not convey any hydraulic fluid F in any direction, so that the hydraulic fluid F within the pressure circuit 4 rests motionless and keeps the piston rod 8 through the preloaded pressure in its position.

FIG. 4 shows one embodiment of the method according to the invention for operating the inventive hydraulic drive according to FIG. 1 comprising the operating steps of the hydraulic drive 1 in speed mode BE up or down by means of the hydraulic machine 5 and the first and second way valve 6 and 7, whereby the first way valve 6 is arranged in a first pressure line 41 of the pressure circuit 4 and is operated in a first switch position 61, short-circuiting the two cylinder chambers 21, 22 of the working cylinder 2 by enabling a two-way passage of the hydraulic fluid F, whereby the second way valve 7 is operated in a non-return valve position 72, so that the passage in the direction of the upper cylinder chamber 31 of the driving cylinder 3 is blocked, but the hydraulic fluid F is allowed to flow through from the third pressure line 43 through the second pressure line 42 into the first pressure line 41, and whereby the hydraulic machine 5 conveys the hydraulic fluid F for a movement R1 of the piston rod 8 in the direction of the lower cylinder chambers 22, 32 and for a movement R2 in the direction of the upper cylinder chambers 21, 31; as well as for operating the hydraulic drive 1 in power mode down BK, whereby the first way valve 6 is operated in a second switch position 62, which blocks the first pressure line 41 in both directions, whereby the second way valve 7 remains in the non-return valve position 72 of the speed mode, and whereby the hydraulic machine 5 conveys the hydraulic fluid F in the direction of the upper cylinder chambers 21, 31; as well as for release BS of the hydraulic drive 1 after the power mode down BK, whereby the first way valve 6 remains in the second switch position 62 of the power mode down, whereby the second way valve 7 is operated in a first switch position 71, which enables a two-way passage of the hydraulic Fluid F for short-circuiting of the two upper cylinder chambers 21, 31, and whereby the hydraulic machine 5 conveys the hydraulic Fluid F in the direction of the lower cylinder chambers 22, 32. After that, in this embodiment, the speed mode BE follows, which was already described above in FIG. 3*a*, with the switch positions of the two way valves 6, 7 and the corresponding conveying direction of the hydraulic machine 5 in opposite direction to the speed mode down and the repeated performing of the release phase BS, but with opposite conveying direction of the hydraulic machine as compared to the release phase BS after the power mode down BK. After that, either the repeated performance of the operation phases described above can follow (speed mode down BE; power mode down BK, release phase BS, speed mode up BE and release phase BS and so forth), or a transition into the holding position BH with the switch positions 62 and 73 of the first and second way valves 6, 7. The individual switch positions and the operation of the hydraulic machine 5 in one of the two conveying directions for the hydraulic fluid F, or no conveying by the hydraulic machine 5, can hereby be set, controlled and/or switched in an appropriate way. Preferably, the switch positions are set by a drive control unit 9 of the hydraulic drive 1 and the hydraulic machine is controlled accordingly. The corresponding controls can be saved in the drive control unit 9 via hardware or software. Initiating (starting) the drive control unit can be done automatically or manually. In an alternative embodiment, the individual operation phases are set manually or can be set manually.

The embodiments shown here represent only examples of the present invention, and are therefore not to be understood as limiting. Alternative embodiments considered by the person skilled in the art are similarly encompassed by the protective scope of the present invention.

LIST OF REFERENCE CHARACTERS

1 hydraulic drive
2 working cylinder
21 upper cylinder chamber of the working cylinder
22 lower cylinder chamber of the working cylinder
23 piston surface (ring surface) of the working cylinder
3 driving cylinder
31 upper cylinder chamber of the driving cylinder
32 lower cylinder chamber of the driving cylinder
33 piston surface (ring surface) of the driving cylinder
4 pressure circuit
41 first pressure line of the pressure circuit
42 second pressure line of the pressure circuit
43 third pressure line of the pressure circuit
44 fourth pressure line of the pressure circuit
45 fifth pressure line of the pressure circuit
5 hydraulic machine
51 first pressure connection of the hydraulic machine to the pressure circuit
52 second pressure connection of the hydraulic machine to the pressure circuit
53 pump of the hydraulic machine
54 motor of the hydraulic machine
6 first way valve
61 first switch position of the first way valve
62 second switch position of the first way valve
7 second way valve
71 first switch position of the second way valve
72 second switch position of the second way valve
73 third switch position of the second way valve
8 combined piston rod of the working and driving cylinder
9 drive control unit of the hydraulic drive
BE operation of the hydraulic drive in the operation phase "speed mode"
BH operation of the hydraulic drive in the operation phase "holding position"
BK operation of the hydraulic drive in the operation phase "power mode"
BS operation of the hydraulic drive in the operation phase "release mode"
F hydraulic fluid
R1, R2 piston movement directions (up/down or in/out)

The invention claimed is:

1. A hydraulic drive comprising:

a working cylinder and a driving cylinder mechanically connected with the working cylinder, wherein the working cylinder and the driving cylinder each comprise an upper and a lower cylinder chamber and the upper and lower cylinder chambers of the working cylinder and the driving cylinder are connected with each other in a closed pressure circuit filled with a hydraulic fluid and preloaded, a hydraulic machine with a first and a second pressure connection arranged in the pressure circuit for transferring the hydraulic fluid between the individual cylinder chambers of the working cylinder and the driving cylinder during operation of the hydraulic drive, wherein the first pressure connection of the hydraulic machine is connected via a first and a second pressure line of the pressure circuit with the corresponding upper cylinder chambers of the working and driving cylinders, wherein at least a first way valve and a second way valve are arranged within the pressure circuit in such a way that each of their switch positions that are appropriate for the different operational phases of the hydraulic drive, along with the appropriately operated hydraulic machine, enable a combined movement of the working cylinder and the driving cylinder in one or the other piston movement directions, wherein the second way valve is arranged in the second pressure line to the upper cylinder chamber of the working cylinder, wherein the second way valve is a 2/3-way valve comprising three different switch positions, wherein a first switch position of the second way valve enables a two-way passage of the hydraulic fluid for short-circuiting the two upper cylinder chambers, wherein a second switch position of the second way valve is a non-return switch position, whereby the passage in the direction of the upper cylinder chamber of the driving cylinder is blocked and the flow in the reverse direction is enabled, and wherein a third switch position of the second way valve blocks the second pressure line in both directions.

2. The hydraulic drive according to claim 1, wherein the second pressure connection of the hydraulic machine is connected with the lower cylinder chambers of the working and driving cylinders via a third and a fourth pressure line of the pressure circuit without interposed way valves.

3. The hydraulic drive according to claim 1, wherein both the working cylinder and the driving cylinder are double rod cylinders with corresponding ring surfaces as piston surfaces.

4. The hydraulic drive according to claim 3, wherein the working cylinder and the driving cylinder are arranged as tandem cylinder with a combined piston rod.

5. The hydraulic drive according to claim 4, wherein the piston surfaces of the driving cylinder are smaller than the piston surfaces of the working cylinder.

6. The hydraulic drive according to claim 1, wherein the hydraulic machine comprises only one pump and one motor mechanically coupled with the pump for driving the pump, whereby the motor is a variable speed motor and/or the pump is a variable pump.

7. The hydraulic drive according to claim 1, wherein the hydraulic machine can change its direction of rotation.

8. A pressing machine, bending machine or punch machine comprising a hydraulic drive according to claim 1.

9. The hydraulic drive according to claim 1, wherein the first way valve is arranged in a third pressure line of the pressure circuit, which connects the two cylinder chambers of the working cylinder with each other and in a first switch position enables a two-way passage of the hydraulic fluid for short-circuiting the two cylinder chambers.

10. The hydraulic drive according to claim 9, wherein the first way valve is a 2/2-way valve, designed to block the third pressure line in the second switch position in both directions.

11. The hydraulic drive according to claim 1, wherein the hydraulic drive provides a power mode up and a power mode down.

12. The hydraulic drive according to claim 1, wherein only the first way valve, the second way valve, and the hydraulic machine are arranged in the pressure circuit to enable the combined movement of the working cylinder and the driving cylinder in one or the other piston movement directions.

13. A method for operating a hydraulic drive, comprising:

providing mechanically coupled working and driving cylinders each having one upper and one lower cylinder chamber, wherein the upper and lower cylinder chambers of the working and driving cylinders are connected to each other within a closed pressure circuit that is filled with a hydraulic fluid and preloaded;

providing a hydraulic machine with a first and a second pressure connection within the pressure circuit operable to transfer the hydraulic fluid between the individual cylinder chambers of the working and driving cylinders during operation of the hydraulic drive, wherein the first pressure connection of the hydraulic machine is connected via a first and a second pressure line of the pressure circuit with the respective upper cylinder chambers of the working and driving cylinders;

providing at least a first way valve and a second way valve within the pressure circuit, wherein the first and second way valves are disposed within the pressure circuit such that their switch positions for the different operational phases of the hydraulic drive enable a combined movement of the working cylinder and the driving cylinder in one or the other piston movement directions, wherein the second way valve is arranged in the second pressure line to the upper cylinder chamber of the working cylinder;

operating the hydraulic drive in speed mode up or down by means of the hydraulic machine and the first and second way valves, whereby the first way valve is arranged in a third pressure line of the pressure circuit and is operated in a first switch position, which short-circuits the two cylinder chambers of the working cylinder for two-way passage of the hydraulic fluid, whereby the second way valve is operated in a non-return valve position, so that the passage in the direction of the upper cylinder chamber of the driving cylinder is blocked, and whereby the hydraulic machine conveys the hydraulic fluid for a movement of the piston rod in the direction of the lower cylinder chambers and for a movement in the direction of the upper cylinder chambers;

operating the hydraulic drive in power mode, whereby the first way valve is operated in a second switch position, which blocks the third pressure line in both directions, whereby the second way valve remains in the non-return valve position of the speed mode, and whereby the hydraulic machine conveys the hydraulic fluid in the direction of the upper cylinder chambers; and releasing the hydraulic drive after power mode, whereby the first way valve remains in the second switch position of the power mode, whereby the second way valve is operated in a first switch position, which enables a two-way passage of the hydraulic fluid for short-circuiting the two upper cylinder chambers, and whereby the hydraulic machine conveys the hydraulic fluid in the direction of the lower cylinder chambers.

14. The method according to claim 13, further comprising the step of operating the hydraulic drive during standstill, whereby the first and the second way valves are operated in a switch position, which blocks the corresponding pressure lines in both directions, and whereby the hydraulic machine does not convey the hydraulic fluid.

15. The method according to claim 14, further comprising the step of operating the hydraulic machine by means of a mechanically coupled electric motor with variable speed.

* * * * *